United States Patent [19]

Hayashi et al.

[11] Patent Number: 4,768,472

[45] Date of Patent: Sep. 6, 1988

[54] COOLING SYSTEM FOR AN INTERNAL COMBUSTION ENGINE

[75] Inventors: Masaharu Hayashi; Masato Itakura; Kenji Shindo, all of Toyota, Japan

[73] Assignee: Aisin Seiki Kabushiki Kaisha, Kariya, Japan

[21] Appl. No.: 17,451

[22] Filed: Feb. 24, 1987

[30] Foreign Application Priority Data

Feb. 21, 1986 [JP] Japan ..... 61-036870

[51] Int. Cl.[4] ..... F01P 7/10

[52] U.S. Cl. ..... 123/41.49; 415/119; 415/170 R; 415/172 A

[58] Field of Search ..... 416/189, 192; 415/172 A; 123/41.49

[56] References Cited

U.S. PATENT DOCUMENTS

| | | | |
|---|---|---|---|
| 3,321,931 | 5/1967 | Lehmkuhl | 415/119 |
| 3,433,403 | 3/1969 | Gerlitz | 415/119 |
| 3,842,902 | 10/1974 | Poslusny | 415/170 R |
| 4,329,946 | 5/1982 | Longhouse | 123/41.49 |
| 4,505,641 | 3/1985 | Tsuchikawa et al. | 415/172 A |
| 4,514,140 | 4/1985 | Knopf | 415/119 |
| 4,684,324 | 8/1987 | Perosino | 415/119 |

FOREIGN PATENT DOCUMENTS

| | | |
|---|---|---|
| 11203 | 1/1977 | Japan . |
| 58305 | 5/1985 | Japan . |

*Primary Examiner*—Henry C. Yuen

*Attorney, Agent, or Firm*—Oblon, Fisher, Spivak, McClelland & Maier

[57] ABSTRACT

A cooling system for an internal combustion engine, which includes a fan having a boss coupled to an input member, a plurality of blades projecting substantially radially from the boss and a thin cylindrical ring coaxial with the boss and integrated around the blades, and a shroud arranged around the fan with a clearance therebetween. The ring has a cylindrical portion in its intake side and is bent, with a curvature, outwardly toward its exhaust side. The relative arrangement of the fan with the ring and the shroud is such that a maximum diameter of the ring/(the diameter of the cylindrical portion of the ring+the clearance×2) is established in the range of 0.97 to 1.04, that the curvature/the diameter of the cylindrical portion of the ring is established in the range of 0.05 to 0.08, and that overlapping length of the shroud with the ring is established in the range of 0.17 to 0.70.

2 Claims, 8 Drawing Sheets

COOLING SYSTEM FOR AN INTERNAL COMBUSTION ENGINE

BACKGROUND OF THE INVENTION

1. Field of the Invention

The present invention relates to a cooling system for an internal combustion engine, in which a ring is integrated around a plurality of fan blades.

2. Description of the Prior Art

A typical cooling fan includes a boss 1 coupled to an input member, and a plurality of fan blades projecting radially outwardly from the outer periphery of the boss 1 as shown in FIGS. 12 and 13. There are a few disadvantages to this arrangement. First, cool air passes through a clearance 4 between the tips of the blades 2 and a shroud 3 as best seen in FIG. 12. This counterflow of air A causes a reduction in the volume of cool air. Secondly, a spiral flow of air B is created around the tips of the blades 2 as best seen in FIG. 13. This results in the occurrence of undesirable noise.

Japanese utility model laid-open publication No. 52/11203 discloses an improved cooling system wherein a cooling fan is surrounded by a ring 5 (see FIG. 14). The disclosed cooling system, particularly those illustrated in FIGS. 15(A) and 15(B), is easy to manufacture and install. In this system, the ring 5 has a small curvature from a cylindrical portion to a portion of maximum diameter, the maximum diameter portion being 1.0 to 1.3 times greater than the diameter of the cylindrical portion. Also, the shroud 3 overlaps the cooling fan, with or without a ring, by half of, or equal to the axial width of the fan.

Various attempts have also been made to reduce the noise. See, for example, Japanese utility model publication No. 60/21518, Japanese patent laid-open publication No. 56/56926 and Japanese utility model laid-open publication No. 50/58305. Rings mounted on cooling fans of these prior cooling system are in bellmouth form. It has been found that such a bellmouth-shaped ring is more effective in reducing the noise than those stated in the preceding paragraphs. It is apparent, however, that with such bellmouth-shaped ring , it is necessary to increase the size of a radiator by 15 to 20%.

In the design of a cooling system, a radiator is first so sized as to dissipate a substantial amount of heat. Then, a specific type of cooling fan is implemented to provide a substantial flow of air through the radiator. With the size of the radiator fixed, a fan with a ring of a bellmouth form is 10 to 20% smaller in diameter than a fan with ring in general form. It has experimentally found that the former provides a flow of air only 58 to 77% of that of the latter. In order for the former to provide as much a flow of air as the latter, rotational number of the former must be 1.3 to 1.7 times greater than that of the latter. However, this results in a substantial increase in the noise. It should also be noted that mounting of the former to a vehicle body is cumbersome.

SUMMARY OF THE INVENTION

Therefore, it is an object of the invention to provide an improved cooling system for an internal combustion engine, which enables reducing noise to a substantial extent.

It is another object of the invention to provide a cooling system for an internal combustion engine, which can readily be mounted to a vehicle body.

According to the present invention, there is provided a cooling system for an internal combustion engine comprising a fan having a boss coupled to an input member, a plurality of blades projecting substantially radially from said boss and a thin cylindrical ring coaxial with said boss and integrated around said blades, and a shroud arranged around said fan with a clearance therebetween, said ring having a cylindrical portion in its intake side and being bent, with a curvature, outwardly toward its exhaust side, and the relative arrangement of the fan with the ring and the shroud being such that a maximum diameter of the ring/(the diameter of the cylindrical portion of the ring+the clearance between the ring and the shroud $\times 2$) is in the range of 0.97 to 1.04, that the curvature/the diameter of the cylindrical portion of the ring is in the range of 0.05 to 0.08, and that an overlapping length of the shroud with the ring/an axial width of the ring is in the range of 0.17 to 0.70.

The fan blades are so arranged that a reference line extending along front two-fifths of the blade section is bent in such a direction that the blades are rotated, and is also bent toward the intake side of the fan between the boss and the ring.

BRIEF DESCRIPTION OF THE DRAWINGS

Further objects, aspects, and advantages of the invention will be more apparent upon a consideration of the following description, when taken in conjunction with the accompanying drawings, in which.

DESCRIPTION OF THE PREFERRED EMBODIMENTS

Figure 1:
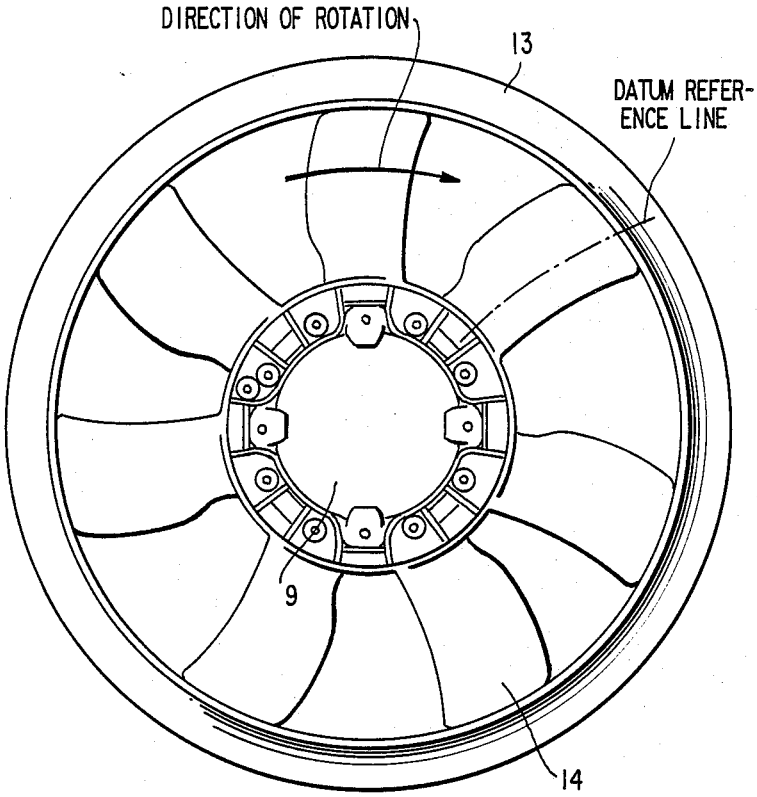
FIG. 1 is a front view of a cooling system according to the present invention.
Figure 2:
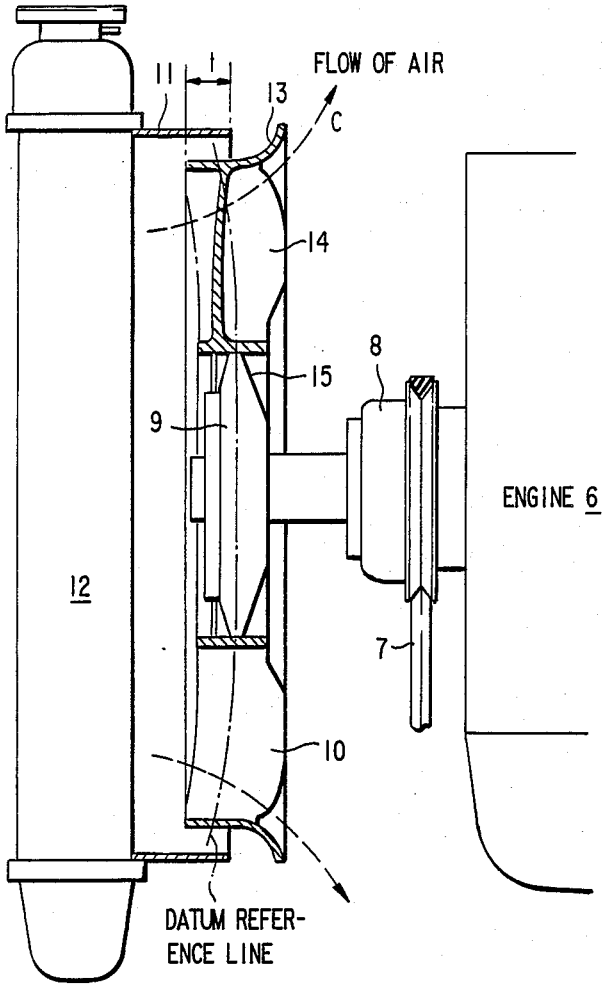
FIG. 2 is a side view, partly in section, of the cooling system shown in FIG. 1.
Figure 3:
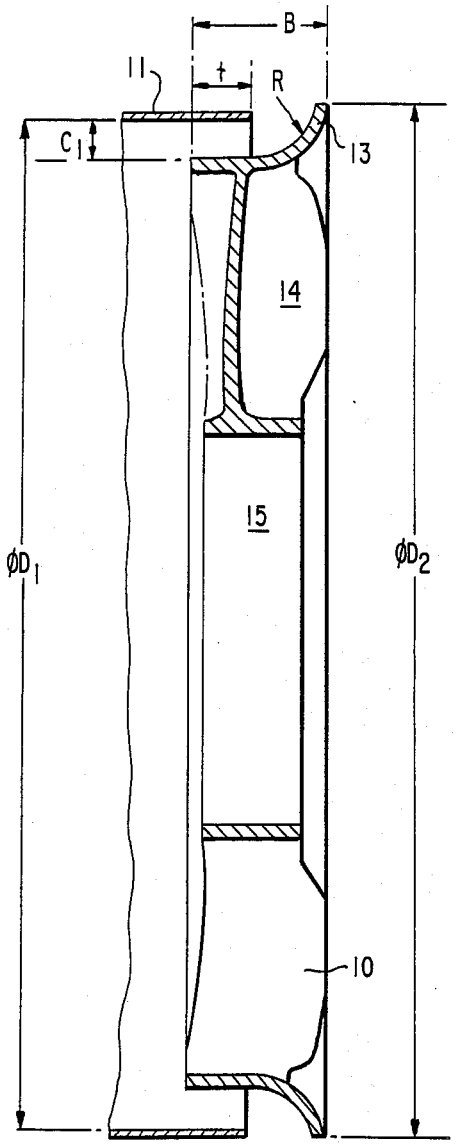
FIG. 3 is a view similar to FIG. 2, showing the dimension of a cooling fan.

With reference to FIGS. 1 to 3, an engine 6 has a crankshaft (not shown), rotary motion of which is transmitted through a belt 7 to a pulley 8 and an input shaft of a viscous fluid joint 9. This rotary motion causes a fan 10 to rotate in a predetermined direction. The fan 10 is surrounded by a right cylindrical tubular shroud 11 with a clearance C therebetween. This clearance serves as an air duct. The fan 10 is to provide a flow of air through a radiator 12 and then direct the air in a direction outwardly and rearwardly thereof, as shown in by the arrow C. Integrated around the fan 10 is a ring having an outwardly bent peripheral edge.

Figure 10:
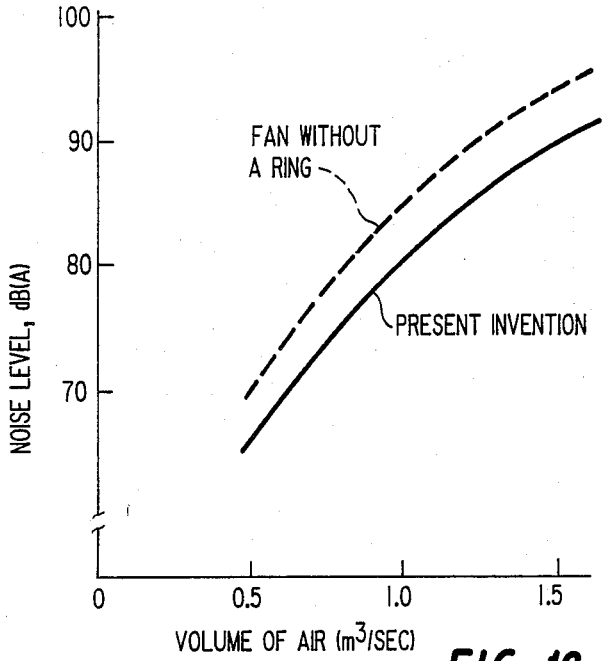
FIG. 10 is a graph showing noise levels in relation the volume of air.
Figure 11:
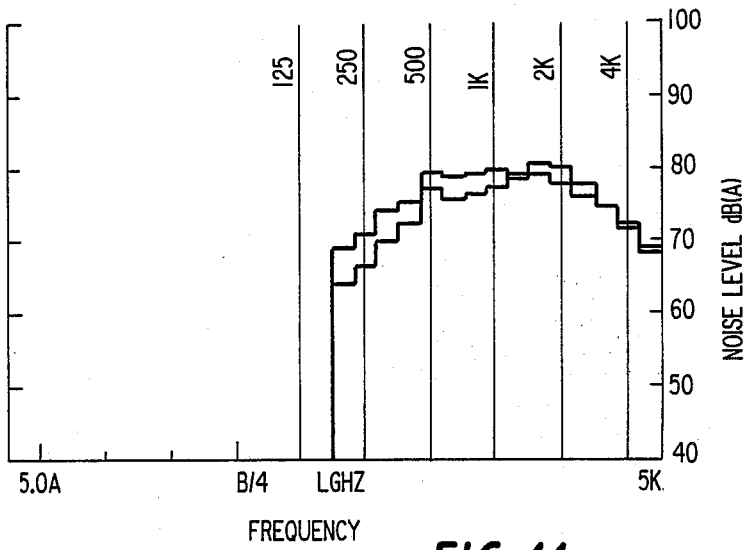
FIG. 11 is a graph showing noise levels in relation to frequency.
Figure 12:
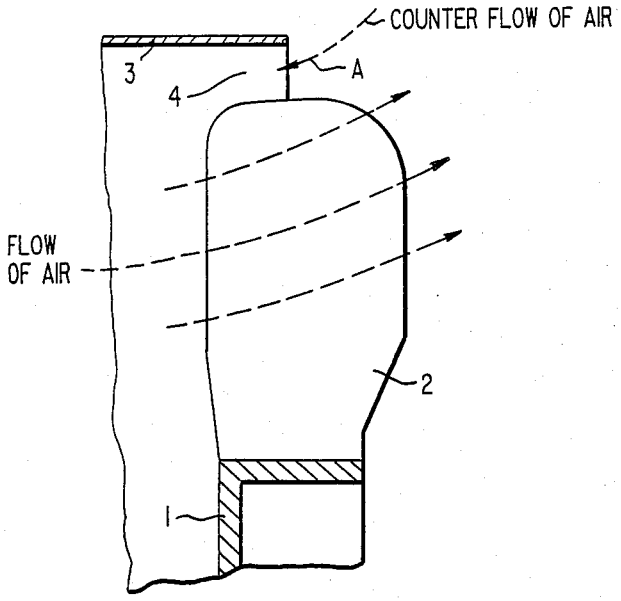
FIG. 12 PRIOR ART
FIG. 12 is a diagrammatic view showing a counterflow of air around the blade of a conventional fan.
Figure 13:
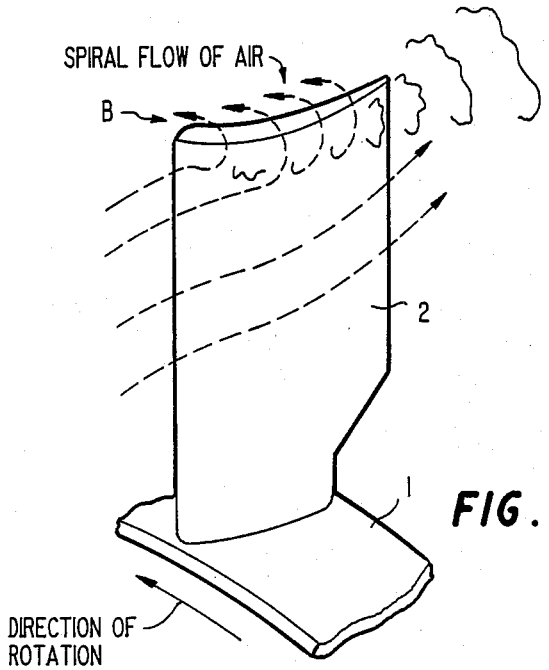
FIG. 13 PRIOR ART
FIG. 13 is a view similar to FIG. 12, but showing a spiral flow of air around the blade of a conventional fan.

A significant feature of the present invention resides in the relative arrangement of the fan 10 with the integral ring 13 and the shroud 11. More specifically, in FIG. 3, the value of $D_2/(D_1+C\times2)$ is established in the range of 0.97 to 1.04, the value of $R/D_1$ is established in the range of 0.05 to 0.08, and the value of t/B is established in the range of 0.17 to 0.70. When the maximum diameter of the ring $D_1$ is 470$\phi$, the diameter of a cylindrical portion of the ring $D_1$ is 410$\phi$, a curvature of the ring R is 30, the width of the ring B is 70, and overlapping length of the ring and the shroud t is 30, $D_2/D_1+2C$ is approximately 1.02, $R/D_1$ is apprximately 0.073, and t/B is approximately 0.43. As is clear from FIG. 10, the fan with the integral ring is more effective in reducing noise than a conventional fan of 410 in diameter.

In FIG. 2, a reference line extends along the front two-fifths of blade section. This reference line is bent in such a direction that the blades are rotated, and is also bent toward the intake side of the fan between the boss and the ring. This particular type of cooling fan is called "bend fan," and makes less noise than a conventional fan with a straight reference line.

Figure 4:
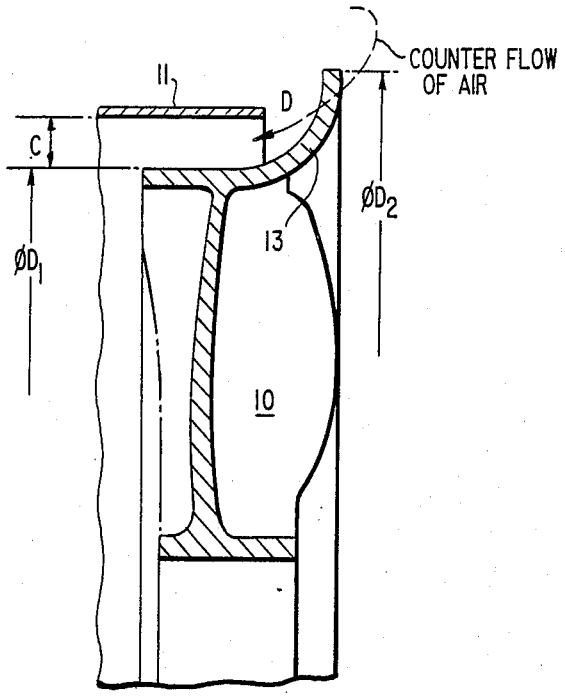
FIG. 4 is an enlarged side view, partly in section, of the fan.
Figure 5:
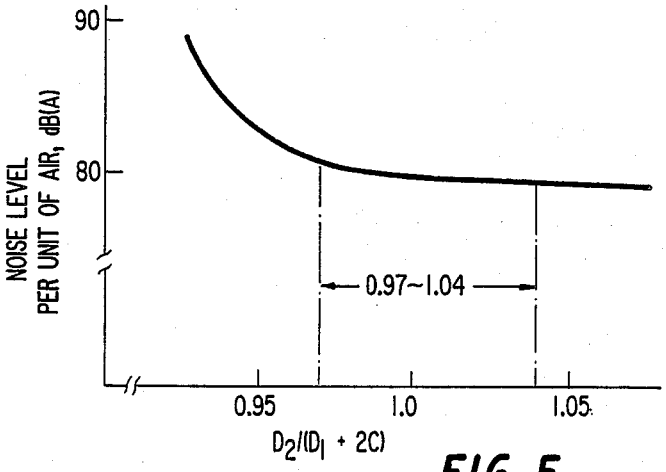
FIG. 5 is a graph showing noise levels in relation to the value of $D/(D+2C)$.

Reference is next made to FIG. 4. It is apparent that the greater the value of $D_2$, the lesser the occurrence of a counterflow of air D. However, the value $D_2$ can not freely be increased. This is due to the fact that if the value of $D_2$ exceeds the upper limit, then it is difficult to mount the fan to a vehicle body. FIG. 5 shows noise levels in relation to the value of $D_2/(D_1+2C)$ in a typical cooling system. As is clear from FIG. 5, the noise levels are substantially constant where the value of $D_2/(D_1+2C)$ is greater than 0.97. Although an upper limit of the value of $D_2/(D_1+2C)$ should be determined in accordance with the type of a motor vehicle to which a cooling system is mounted, the upper limit is experimentally established to be 1.04 in the preferred embodiment of the invention.

Figure 6:
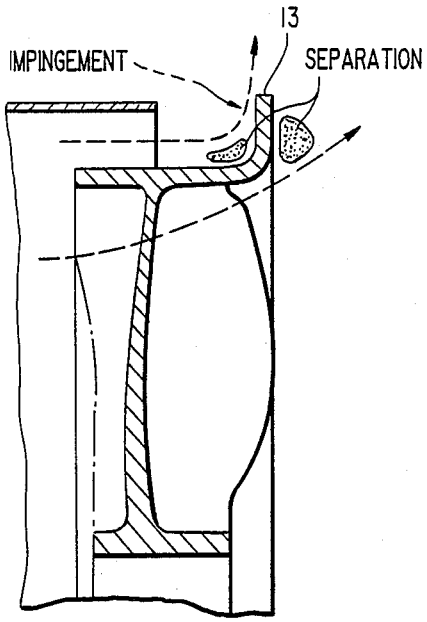
FIG. 6 is a view similar to FIG. 4, but showing the shape of a ring when the value of $R/D_1$ is small.
Figure 7:
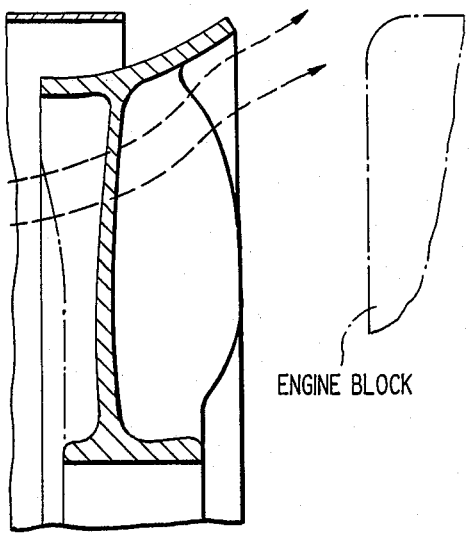
FIG. 7 is a view similar to FIG. 7, but showing the shape of a ring when the value of $R/D_1$ is large.
Figure 8:
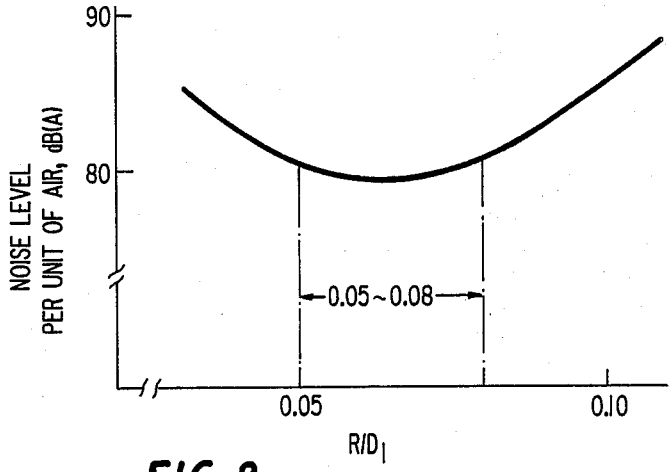
FIG. 8 is a graph showing noise levels in relation to the value of $R/D_1$.

As shown in FIG. 6, if the value of $R/D_1$ is small, then cool air may pass separately through opposite sides of the ring 13, or may impinge the ring 13. This results in a lesser volume of air and greater noise. On the other hand, if the value of $R/D_1$ is large, then an inclined flow of air is restricted as shown in FIG. 7. Consequently, the air impinges an engine block or related parts. This causes an increase in interference noise, an increase in resistance to air in a blower system, and a reduction in the volume of air. FIG. 8 shows noise levels in relation to the value of $R/D_1$. As is clear from FIG. 8, the fan makes less noise when the value of $R/D_1$ is in the range of 0.05 to 0.08.

Figure 9:
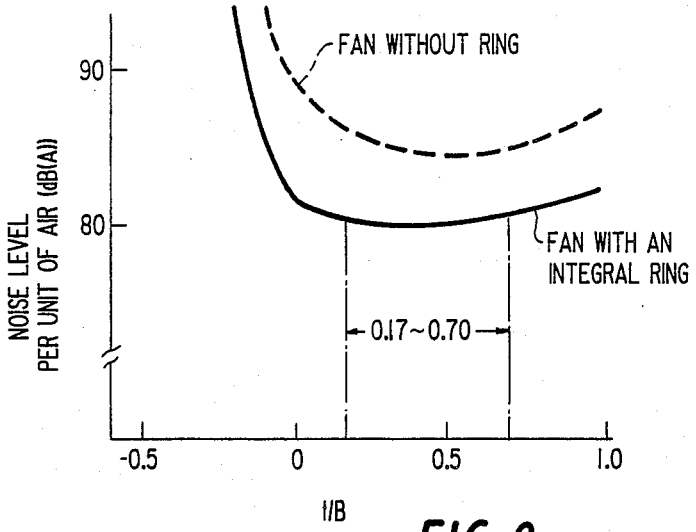
FIG. 9 is a graph showing noise levels in relation to the value of t/B.
Figure 14:
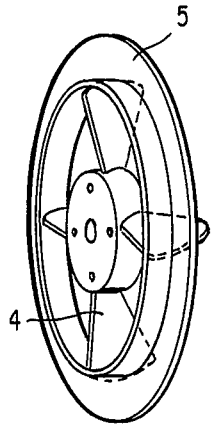
FIG. 14 PRIOR ART
FIG. 14 is perspective view of a conventional fan with an integral ring.
Figure 15A:
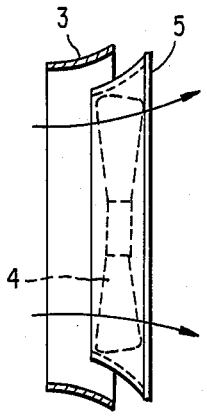
FIG. 15A PRIOR ART
FIGS. 15(A) and 15(B) are side views of the fan shown in FIG. 14, respectively, showing a typical flow of air through the fan.
Figure 15B:
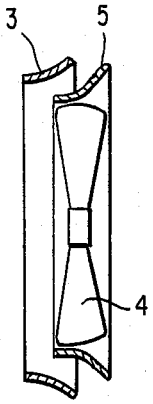
FIG. 15B PRIOR ART

With reference to FIG. 9, the value of t/B has less influence on the noise levels. This is due to the fact that air flow within the ring is rarely affected under the influence of the shroud. In accordance with the invention, the value of t/B is established in the range of 0.17 to 0.70. This arrangemnt enables the fan to reduce the noise a substantial amount.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description.

What is claimed is:

1. A colling system for an internal combustion engine, comprising: a fan having a boss coupled to an input member, a plurality of blades projecting substantially radially from said boss and a thin cylindrical ring coaxial with said boss and integrated around said blades, and a right cylindrical tubular shroud arranged around said fan with a clearance therebetween, said ring having a cylindrical portion in its intake side and being bent, with a curvature, outwardly toward its exhaust side, and relative arrangement of said fan with said ring and said shroud being such that a maximum diameter of said ring/(the diameter of said cylindrical portion of the ring+said clearance $\times2$) is established in the range of 0.97 to 1.04, that said curvature/the diameter of said cylindrical portion of the ring is established in the range of 0.05 to 0.08, and that an overlapping length of said shroud with said ring is established in the range of 0.17 to 0.70.

2. A cooling system for an internal combustion engine as set forth in claim 1, wherein said blades of the fan are so arranged that a reference line extending along a front two-fifths of an axial blade section is bent in such a direction that said blades are rotated about the axis of said fan and is bent toward said intake side of said fan between said boss and said ring.

* * * * *